US006287027B1

(12) United States Patent
Komiya et al.

(10) Patent No.: US 6,287,027 B1
(45) Date of Patent: Sep. 11, 2001

(54) IMAGE CORRECTION SYSTEM FOR IMAGE PRINTING APPARATUS USING MULTIHEAD

(75) Inventors: Yasuhiro Komiya, Hino; Ken Ioka; Yoshinobu Omata, both of Hachioji, all of (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 09/442,417

(22) Filed: Nov. 18, 1999

(30) Foreign Application Priority Data

Dec. 11, 1998 (JP) ..... 10-353253

(51) Int. Cl.[7] ..... B41J 3/42; B41J 5/30
(52) U.S. Cl. ..... 400/74; 358/1.09
(58) Field of Search ..... 400/74; 395/109; 358/1.09

(56) References Cited

U.S. PATENT DOCUMENTS

| | | | | |
|---|---|---|---|---|
| 5,469,267 | * | 11/1995 | Wang | 358/298 |
| 5,546,165 | * | 8/1996 | Rushing et al. | 355/208 |
| 5,565,995 | * | 10/1996 | Yamada et al. | 358/298 |
| 5,751,311 | * | 5/1998 | Drake | 347/43 |
| 5,854,882 | * | 12/1998 | Wang | 395/109 |
| 6,026,216 | * | 12/1998 | Ohtsuka et al. | 395/109 |

FOREIGN PATENT DOCUMENTS 61-121658 6/1986 (JP) .

* cited by examiner

*Primary Examiner*—John S. Hilten
*Assistant Examiner*—Charles H. Nolan, Jr.
(74) *Attorney, Agent, or Firm*—Frishauf, Holtz, Goodman, Langer & Chick, P.C.

(57) ABSTRACT

A printing apparatus prints an image by one head formed by adhering a plurality of print heads each having a plurality of nozzles in the main scanning direction. An image correction apparatus for the printing apparatus includes a printer, reader, correction coefficient calculation unit, image correction unit, and smoothing unit. The printer prints a predetermined correction chart so as to ensure a partially overlapping region in a region printed by main scanning of the print heads. The reader reads a printed image of the predetermined correction chart printed by the printer. The correction coefficient calculation unit calculates a predetermined correction coefficient on the basis of the printed image of the predetermined correction chart read by the reader. The image correction unit performs predetermined image correction in advance for printing image signals input to the print heads, on the basis of the predetermined correction coefficient calculated by the correction coefficient calculation unit. The smoothing unit performs, for the printing image signals input to the print heads, signal processing for smoothing in advance a density value at a portion corresponding to the overlapping region with respect to a density value at a portion other than the portion corresponding to the overlapping region.

14 Claims, 9 Drawing Sheets

IMAGE CORRECTION SYSTEM FOR IMAGE PRINTING APPARATUS USING MULTIHEAD

BACKGROUND OF THE INVENTION

The present invention relates to an image printing apparatus and, more particularly, to an image correction system for correcting density nonuniformity between a plurality of heads or density nonuniformity between main-scanned images by a print head.

In recent years, image printing using inkjet print heads and thermal print heads as image printing apparatuses has rapidly being spread with the development of electronic video devices. Particularly, image printing using a high-speed printing multihead have been developed.

An image printing apparatus using a multihead prints an image by one head formed by adhering a plurality of print heads each having a plurality of nozzles.

FIG. 17A shows an ideal image printing state by the multihead printing apparatus.

In FIG. 17A, upper black dots form an image printed by a head H1, whereas lower blank dots form an image printed by a head H2.

To form an adhered head so as to print a clear image, as shown in FIG. 17A, the heads H1 and H2 must be aligned with a very high precision.

However, if the heads H1 and H2 are excessively apart from each other at different angles, as shown in FIG. 17B, a blank stripe appears in an image corresponding to the joint between the heads H1 and H2, or images printed by the upper and lower heads geometrically change.

If the heads H1 and H2 overlap each other at different angles, as shown in FIG. 17C, a black stripe appears in an image printed at the joint between the heads H1 and H2.

To prevent this, the conventional multihead printing apparatus requires a long time for adjusting the head position, resulting in a high-cost multihead printing apparatus.

In the conventional multihead printing apparatus, even if heads are aligned with a high precision, printed images may overlap or be omitted at the boundary between one main-scanned image and the next main-scanned image owing to decentering of a roller for feeding a paper sheet serving as a printing medium, a slip of a paper sheet, and the like.

In the conventional multihead printing apparatus, the head position may change over time in accordance with the environment (temperature and humidity) of the printing apparatus and the like. For this reason, the image quality must be properly kept constant in accordance with the instantaneous state of printing.

To solve these problems, Jpn. Pat. Appln. KOKAI Publication No. 61-121658 discloses a printing apparatus wherein previous and current main-scanned images partially overlap each other, and an image is printed based on a predetermined pattern formed such that the previous and current scanned images become complementary to each other in this overlapping region.

The prior art disclosed in Jpn. Pat. Appln. KOKAI Publication No. 61-121658 can avoid to a certain degree a black or blank stripe generated in an image corresponding to the head joint. However, the heads must still be aligned with a high precision.

In addition, Jpn. Pat. Appln. KOKAI Publication No. 61-121658 does not disclose any multihead printing apparatus itself formed by adhering a plurality of heads.

BRIEF SUMMARY OF THE INVENTION

The present invention has been made in consideration of the above situation, and has as its object to provide an image correction system for a multihead image printing apparatus capable of greatly reducing the number of adjustment steps by coping with, by only electrical signal correction, even the attaching errors of a plurality of heads constituting a multihead.

It is another object of the present invention to provide an image correction system for a multihead image printing apparatus which can greatly reduce the number of adjustment steps by only electrical signal correction even when a plurality of heads constituting a multihead have attaching errors, and which corrects on-line the printing state which changes depending on changes over time and environmental changes.

To achieve the above objects, according to the present invention, there is provided (1) an image correction apparatus for a printing apparatus which prints an image by scanning relatively a print head having a plurality of printing elements for forming dots to a printing medium, comprising:

a print head adhered a plurality of unit print heads having a plurality of printing elements for forming dots by overlapping partially at the printing elements in a scanning direction;

a correction unit for performing at least one correction processing of geometric correction, density nonuniformity correction, and color correction corresponding to positional shifts of the print head for input image signals corresponding to the plurality of print heads; and a smoothing unit for changing a signal value at a portion corresponding to the overlapping region of the print head for the input image signals corresponding to the print head.

To achieve the above objects, according to the present invention, there is provided (2) an image correction apparatus defined in (1), further comprising a plurality of print heads each other to print images of different colors.

To achieve the above objects, according to the present invention, there is provided (3) an image correction apparatus defined in (1), wherein the apparatus further comprises:

a test image storage unit for storing a predetermined test image;

an image reader unit for reading a printed image obtained by printing the predetermined test image from the test image storage unit by the heads;

a parameter calculation unit for calculating parameters used for geometric correction, density nonuniformity correction, and color correction by the correction unit from image data read by the image reader unit; and a storage unit for storing the parameters calculated by the parameter calculation unit, and the correction unit performs correction processing using the parameters stored in the storage unit.

To achieve the above objects, according to the present invention, there is provided (4) an image correction apparatus defined in (2), wherein the apparatus further comprises:

a test image storage unit for storing a predetermined test image;

an image reader unit for reading a printed image obtained by printing the predetermined test image from the test image storage unit by the heads;

a parameter calculation unit for calculating parameters used for geometric correction, density nonuniformity correction, and color correction by the correction unit from image data read by the image reader unit; and a storage unit for storing the parameters calculated by the parameter calculation unit, and the correction unit performs correction processing using the parameters stored in the storage unit.

To achieve the above objects, according to the present invention, there is provided (5) an image correction apparatus for a printing apparatus which prints an image by scanning relatively a print head having a plurality of printing elements for forming dots to a printing medium, comprising:

means for causing the print head to ensure partially overlapping a region printed by one scanning and a region printed by next scanning;

a correction unit for performing at least one correction processing of predetermined geometric correction, density nonuniformity correction, and color correction corresponding to positional shifts of the print head for input image signals corresponding to the print head; and a smoothing unit for changing a signal value at a portion corresponding to the overlapping region for the input image signals corresponding to the print head.

To achieve the above objects, according to the present invention, there is provided (6) an image correction apparatus defined in (5), further comprising a plurality of print heads each other to print images of different colors.

To achieve the above objects, according to the present invention, there is provided (7) an image correction apparatus defined in (5), wherein the apparatus further comprises:

a test image storage unit for storing a predetermined test image;

an image reader unit for reading a printed image obtained by printing the predetermined test image from the test image storage unit by the plurality of heads;

a parameter calculation unit for calculating parameters used for geometric correction, density nonuniformity correction, and color correction by the correction unit from image data read by the image reader unit; and a storage unit for storing the parameters calculated by the parameter calculation unit, and the correction unit performs correction processing using the parameters stored in the storage unit.

To achieve the above objects, according to the present invention, there is provided (8) an image correction apparatus defined in (6), wherein the apparatus further comprises:

a test image storage unit for storing a predetermined test image;

an image reader unit for reading a printed image obtained by printing the predetermined test image from the test image storage unit by the plurality of heads;

a parameter calculation unit for calculating parameters used for geometric correction, density nonuniformity correction, and color correction by the correction unit from image data read by the image reader unit; and a storage unit for storing the parameters calculated by the parameter calculation unit, and the correction unit performs correction processing using the parameters stored in the storage unit.

To achieve the above objects, according to the present invention, there is provided (9) an image correction apparatus for a printing apparatus which prints an image by scanning relatively a print head having a plurality of printing elements for forming dots to a printing medium, comprising:

printing means for printing a predetermined correction chart so as to ensure a partially overlapping region in a region printed by scanning of the print head;

reader means for reading a printed image of the predetermined correction chart printed by the printing means;

correction coefficient calculation means for calculating a predetermined correction coefficient on the basis of the printed image of the predetermined correction chart read by the reader means;

an image correction unit for performing predetermined image correction in advance for printing image signals input to the print head, on the basis of the predetermined correction coefficient calculated by the correction coefficient calculation means; and a smoothing unit for performing, for the printing image signals input to the print head, signal processing for smoothing in advance a density value at a portion corresponding to the overlapping region with respect to a density value at a portion other than the portion corresponding to the overlapping region.

To achieve the above objects, according to the present invention, there is provided

(10) an image correction apparatus for a printing apparatus which prints an image by scanning relatively a print head having a plurality of printing elements for forming dots to a printing medium, comprising:

printing means for printing a predetermined correction chart so as to ensure a partially overlapping region in a region printed by scanning of the print head;

reader means for reading a printed image of the predetermined correction chart printed by the printing means;

correction coefficient calculation means for calculating a predetermined correction coefficient on the basis of the printed image of the predetermined correction chart read by the reader means;

an image correction unit for performing predetermined image correction in advance for printing image signals input to the print head, on the basis of the predetermined correction coefficient calculated by the correction coefficient calculation means; and a smoothing unit for performing, for the printing image signals input to the print head, signal processing for smoothing in advance a density value at a portion corresponding to the overlapping region with respect to a density value at a portion other than the portion corresponding to the overlapping region.

To achieve the above objects, according to the present invention, there is provided

(11) an image correction method for a printing apparatus which prints an image by scanning relatively a print head having a plurality of printing elements for forming dots to a printing medium, comprising the steps of:

printing a predetermined correction chart so as to ensure a partially overlapping region in a region printed by scanning of the print head;

reading a printed image of the predetermined correction chart;

calculating a predetermined correction coefficient on the basis of the printed image of the predetermined correction chart;

performing predetermined image correction in advance for printing image signals input to the print head, on the basis of the predetermined correction coefficient; and performing, for the printing image signals input to the print head, signal processing for smoothing in advance a density value at a portion corresponding to the overlapping region with respect to a density value at a portion other than the portion corresponding to the overlapping region.

To achieve the above objects, according to the present invention, there is provided

(12) an image correction method for a printing apparatus which prints an image by scanning relatively a print head having a plurality of printing elements for forming dots to a printing medium, comprising the steps of:

printing a predetermined correction chart by the print head;

reading a printed image of the predetermined correction chart;

calculating a predetermined correction coefficient on the basis of the printed image of the predetermined correction chart; and performing predetermined image correction on-line for printing image signals input to the print head, on the basis of the predetermined correction coefficient.

More specifically, the image correction system according to the present invention detects the positional shift of the head to perform geometric correction and luminance correction for image data to be printed. This system can correct a printing image by only electrical processing without mechanically adjusting an attached head.

Further, the image correction system according to the present invention can correct the positional shift of the head on-line to always maintain a good printing state against changes over time and environmental changes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE INVENTION

Figure 1:
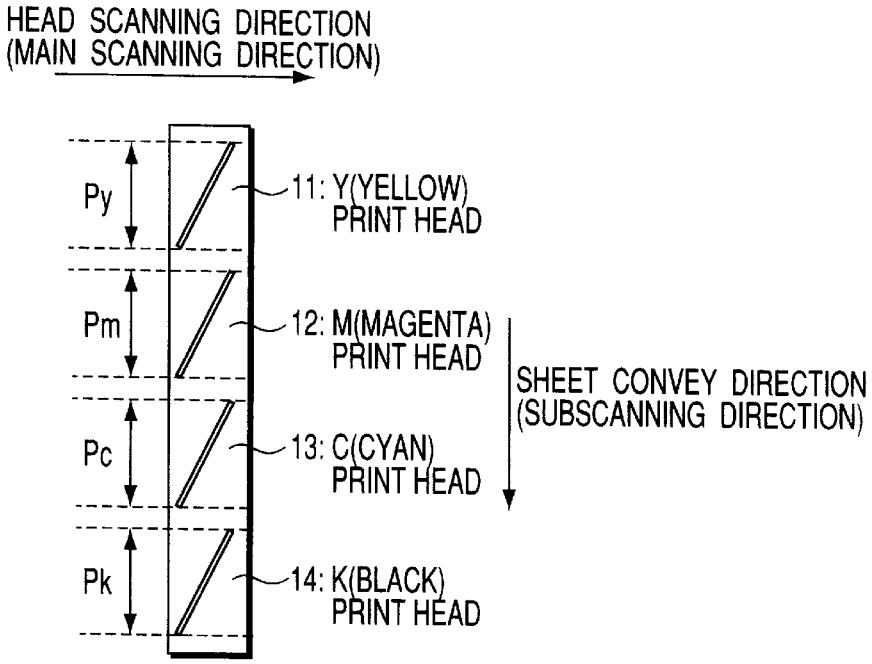
FIG. 1 is a view showing a vertical multihead according to the first embodiment of the present invention.

Reference will now be made in detail to the presently preferred embodiments of the invention as illustrated in the accompanying drawings, in which like reference numerals designate like or corresponding parts.

Preferred embodiments of the present invention will be described below with reference to the several views of the accompanying drawing.

(First Embodiment)

The first embodiment will be described with reference to FIGS. 1 to 5.

FIG. 1 shows a vertical multihead in which a plurality of print heads each having a plurality of nozzles are adhered to form one head.

In FIG. 1, a Y (Yellow) print head 11, M (Magenta) print head 12, C (Cyan) print head 13, and K (black) print head 14 print images in yellow, magenta, cyan, and black, respectively.

The heads 11 to 14 are obliquely attached at azimuth angles.

In FIG. 1, Py, Pm, Pc, and Pk respectively represent the lengths of the heads 11 to 14 in the vertical direction, i.e., the lengths in the convey direction (subscanning direction) of a paper sheet serving as a printing medium printed by the heads 11 to 14.

The values Py, Pm, Pc, and Pk correspond to sheet feed amounts for printing an image by the heads 11 to 14 of the respective colors without any overlapping. Letting P be the convey pitch for feeding a paper sheet, the positions of the heads 11 to 14 must be adjusted to satisfy $$Py=Pm=Pc=Pk=P$$

In practice, however, this adjustment takes a long time. If the heads 11 to 14 are simply attached without performing this time-consuming adjustment, $Py=Pm=Pc=Pk=P$ cannot be satisfied.

Figures 2A, 2B:
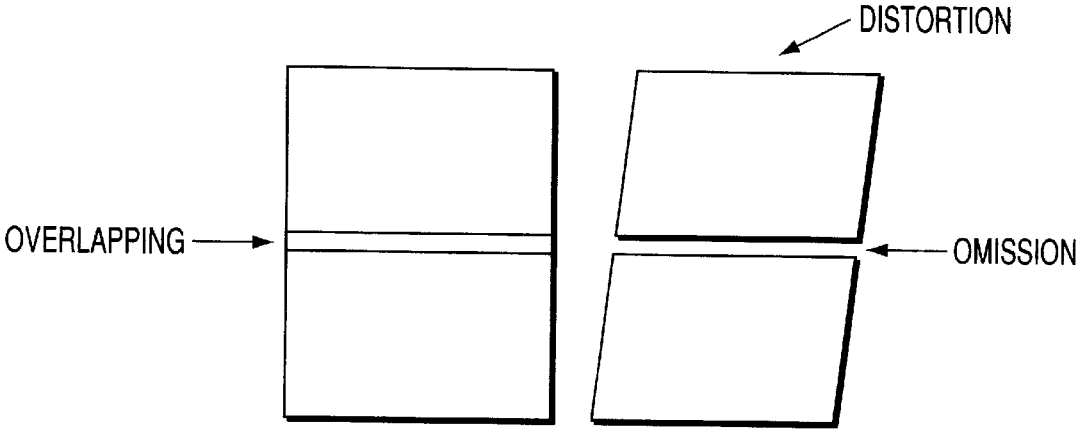
FIGS. 2A and 2B are views each showing the printing state when heads 11 to 14 in FIG. 1 are simply attached.

Thus, when an image is printed by the simply attached multihead, a printed image on the current line may overlap a printed image on the next line at the head joint, as shown in FIG. 2A, or an image may distort to cause a printing omission, as shown in FIG. 2B.

Figure 3:
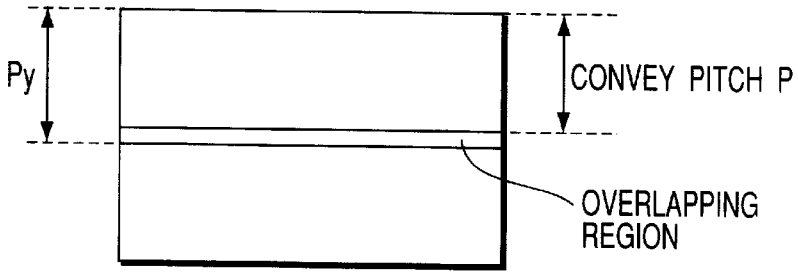
FIG. 3 is a view showing as the first embodiment of the present invention the state in which a convey pitch P for feeding a paper sheet is set smaller than the length of each of the heads 11 to 14 in the sheet convey direction to always ensure an overlapping portion in printing.

To solve these problems, the first embodiment sets the convey pitch P smaller than the length of each of the heads 11 to always 14 in the paper convey direction to ensure an overlapping region in printing, as shown in FIG. 3.

The size of the overlapping region is set in consideration of the maximum error when the heads 11 to 14 are simply attached.

In this embodiment, when predetermined image patterns are printed by the heads 11 to 14, the printed image patterns are read to detect the attaching errors of the heads 11 to 14 as translation amounts and rotation amounts, and printing image data is so corrected as to correct these amounts.

Figure 4A:
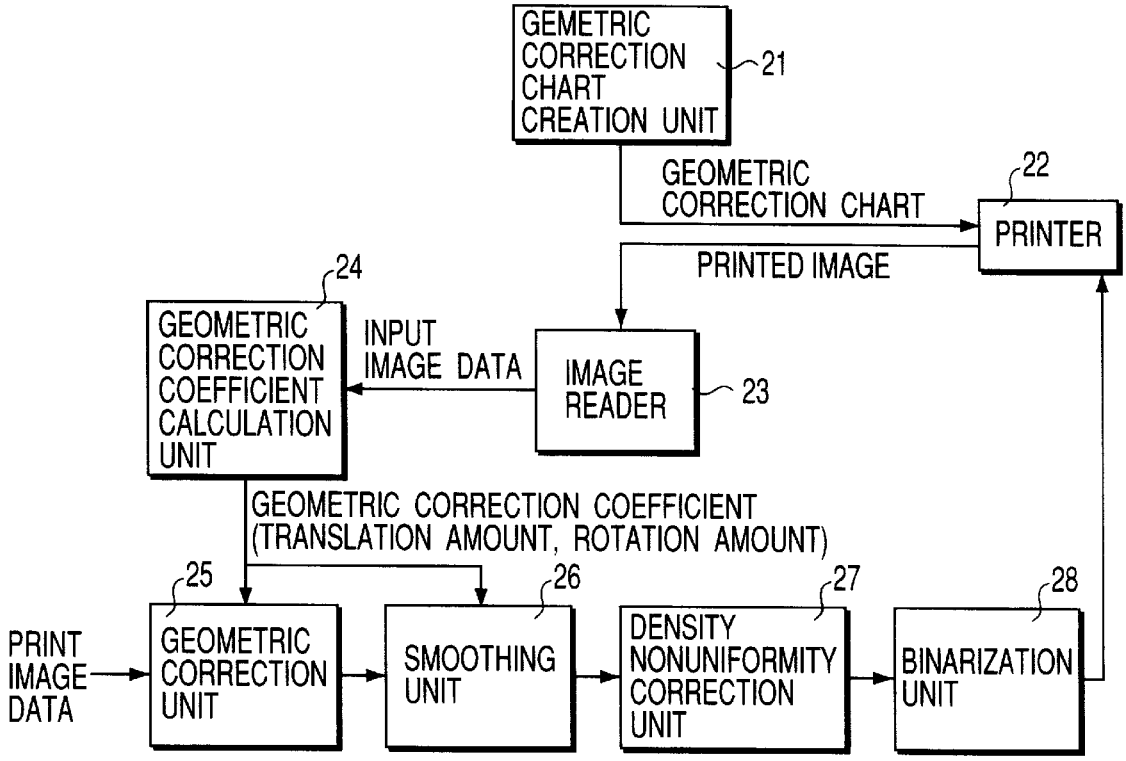
FIGS. 4A and 4B are block diagrams, respectively, showing the schematic arrangement and partial modification of an image correction apparatus according to the first embodiment of the present invention.

FIG. 4A is a block diagram showing the arrangement of an image correction apparatus for correcting printing image data in this manner according to the first embodiment.

As shown in FIG. 4A, a geometric correction chart creation unit 21 creates a geometric correction chart using a predetermined pattern necessary for geometric correction, and prints this chart by a printer 22 having the heads 11 to 14.

An image reader 23 reads with a flat-bed scanner or the like the printed image of the geometric correction chart using the predetermined pattern that is printed by the printer 22, and outputs the read image as input image data to a geometric correction coefficient calculation unit 24.

The geometric correction coefficient calculation unit 24 calculates the translation amounts and rotation amounts of the heads 11 to 14 from their original attaching positions on the basis of the geometric correction chart using the predetermined pattern that is read by the image reader 23, and outputs the calculated amounts to a geometric correction unit 25.

The geometric correction unit 25 geometrically corrects printing image data by performing geometric transformation such as affine transformation using the translation amounts and rotation amounts calculated by the geometric correction coefficient calculation unit 24.

Figure 5:
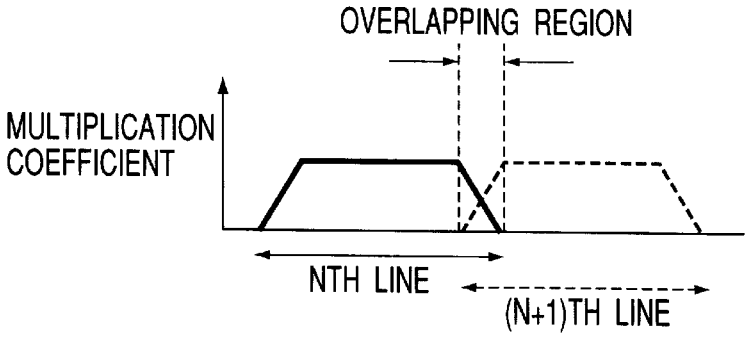
FIG. 5 is a view showing an example of smoothing processing for reducing the signal value of the overlapping region by a smoothing unit 26 in FIG. 4 in order to prevent an increase in printing density in the overlapping region.

A smoothing unit 26 performs smoothing processing for reducing the signal value of the overlapping region, as shown in FIG. 5, in order to prevent an increase in printing density in the overlapping region.

After that, the printing image data undergoes density nonuniformity correction by a density nonuniformity correction unit 27, is binarized by a binarization unit 28, and printed by the printer 22 having the heads 11 to 14.

As described above, the image correction apparatus according to the first embodiment calculates the translation amounts and rotation amounts of the heads 11 to 14 from their original attaching positions in advance on the basis of a geometric correction chart using a predetermined pattern, and performs geometric correction by geometric transformation and smoothing processing for printing image data. Therefore, this apparatus can correct the attaching position errors of the heads 11 to 14 without performing any mechanical adjustment.

Figure 4B:
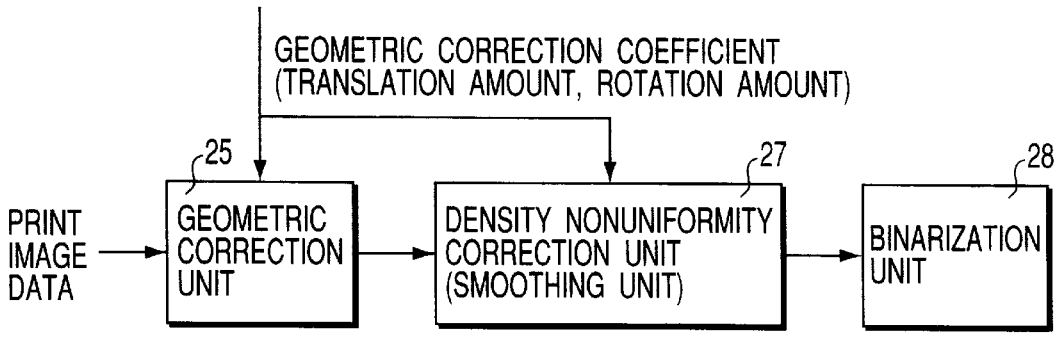

In FIG. 4A, geometric correction and smoothing processing are done before density nonuniformity correction. However, the present invention is not limited to this, and smoothing processing may be done as part of processing by the density nonuniformity correction unit 27, as shown in FIG. 4B.

(Second Embodiment)

The second embodiment will be described with reference to FIG. 6 to FIGS. 8A and 8B.

In the second embodiment, a correction chart using a predetermined pattern necessary for correction is created and printed by a printer 40 having heads 11 to 14. Thereafter, various correction operations are done on-line based on various correction data generated by reading the printed correction chart image pattern. In this way, a good printing state is always maintained.

Various on-line correction operations include three correction operations, i.e., color correction by color management in addition to the above-mentioned density nonuniformity correction and geometric correction.

Note that these correction operations start from geometric correction so as to correct the attaching errors of the heads 11 to 14.

Then, density nonuniformity correction is done to stabilize the density printed by the heads 11 to 14.

In this state, color correction is finally executed.

The on-line correction operations performed in this order can correct the positional shifts of the heads 11 to 14, density nonuniformity, and the printing color which changes depending on the environment and sheet quality.

Note that the three processes are executed as needed, and one or two of them may be omitted.

For example, when the heads 11 to 14 are accurately aligned, the attaching errors of the heads 11 to 14 need not be corrected. All the correction operations may be done in only exchanging the heads 11 to 14, and only color correction may be done in normal use.

Figure 6:
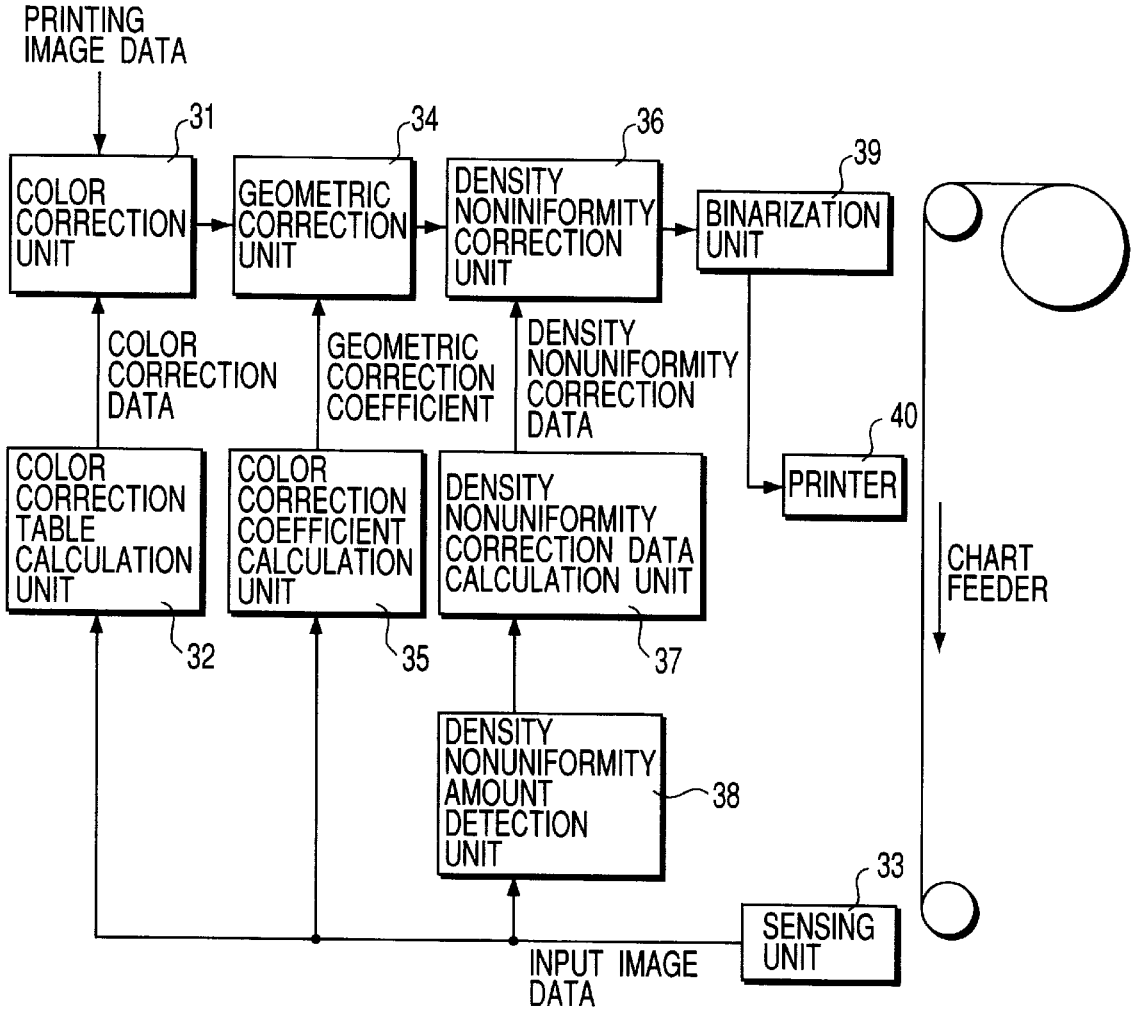
FIG. 6 is a block diagram showing the arrangement of an image correction apparatus for performing on-line correction for printing image data according to the second embodiment of the present invention.

FIG. 6 is a block diagram showing the arrangement of an image correction apparatus for performing on-line correction for printing image data according to the second embodiment.

Figure 7:
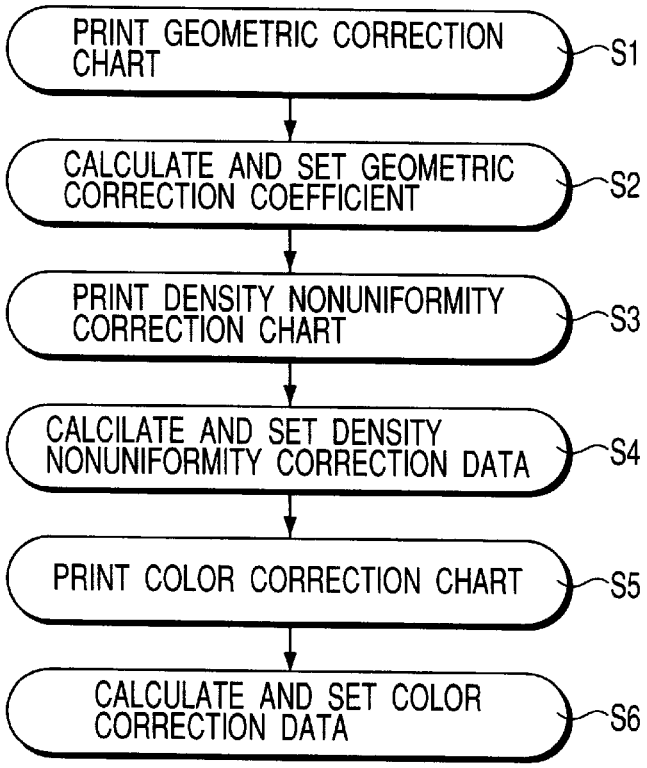
FIG. 7 is a flow chart showing the flow of printing a calibration pattern on a test chart in the image correction apparatus having the arrangement shown in FIG. 6.

FIG. 7 is a flow chart showing the flow of printing a calibration pattern on a correction chart in the image correction apparatus having the arrangement shown in FIG. 6.

A color correction unit 31 shown in FIG. 6 adopts a profile, and performs on-line color correction for printing image data to be finally input to the printer 40 having the heads 11 to 14 via a binarization unit 39 using color correction data calculated as follows by a color correction table calculation unit 32.

Note that this color correction may be done after geometric correction and density nonuniformity correction, as described above.

A geometric correction unit 34 performs on-line geometric correction for printing image data to be finally input to the printer 40 having the heads 11 to 14 via the binarization unit 39, on the basis of a geometric correction coefficient calculated by a geometric correction coefficient calculation unit 35 for the printing image data having undergone color correction by the color correction unit 31.

A density nonuniformity correction unit 36 performs on-line density nonuniformity correction for printing image data to be finally input to the printer 40 having the heads 11 to 14 via the binarization unit 39, on the basis of density nonuniformity correction data calculated by a density nonuniformity correction data calculation unit 37 for the printing image data having undergone geometric correction by the geometric correction unit 34.

The density nonuniformity correction data calculation unit 37 calculates density nonuniformity correction data based on a density nonuniformity amount from a density nonuniformity amount detection unit 38.

A sensing unit 33 includes an image sensor capable of obtaining a color signal. The sensing unit 33 reads various chart images printed by the printer 40, and digitizes them to obtain input image data.

The color correction table calculation unit 32, geometric correction coefficient calculation unit 35, and density nonuniformity amount detection unit 38 respectively execute calculation of color correction data, calculation of the geometric correction coefficient, and detection of the density nonuniformity amount on the basis of the input image data from the sensing unit 33.

Figure 8A:
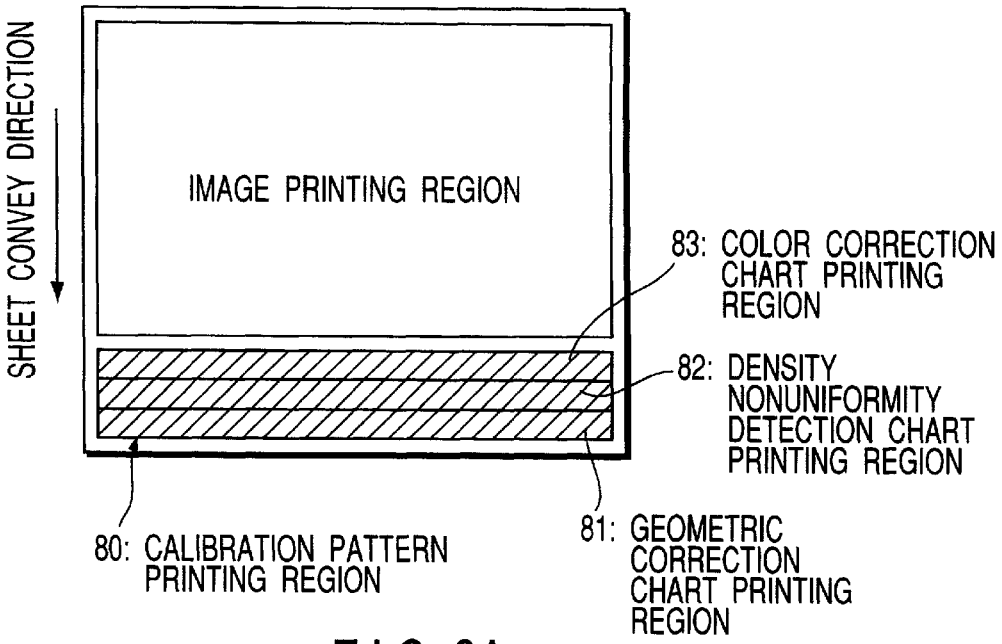
FIGS. 8A and 8B are views each showing an example of a test chart in which a geometric correction chart printing region 81, density nonuniformity detection chart printing region 82, and color correction chart printing region 83 are set in a calibration pattern printing region 80.
Figure 8B:
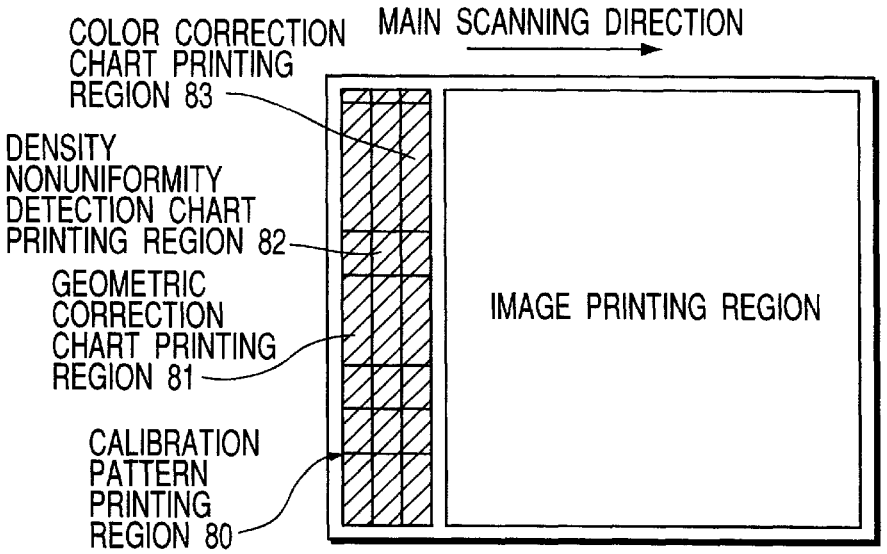

The chart printed by the printer 40 uses a partial region of a printed image, as shown in FIGS. 8A and 8B.

In FIGS. 8A and 8B, a hatched calibration pattern printing region 80 represents the printing region of the chart.

FIG. 8A shows an example of the printing region of each chart set at the start of a printing sheet. The calibration pattern printing region 80 sequentially includes a geometric correction chart printing region 81, density nonuniformity detection chart printing region 82, and color correction chart printing region 83.

Charts for these printing regions 81, 82, and 83 are printed based on the flow chart shown in FIG. 7.

In step S1 shown in FIG. 7, a geometric correction chart for the geometric correction chart printing region 81 is printed.

In step S2, the geometric correction coefficient is calculated and set.

In step S3, a density nonuniformity detection chart for the density nonuniformity detection chart printing region 82 is printed.

In step S4, density nonuniformity correction data is calculated and set.

In step S5, a color correction chart for the color correction chart printing region 83 is printed.

In step S6, color correction data is calculated and set.

FIG. 8B shows an example of printing each chart every main scanning. This example uses a larger number of paper sheets than the example in FIG. 8A, but can keep the printing state better.

The calibration pattern printing region 80 in each of FIGS. 8A and 8B may be automatically cut at the end of image printing or printed on a paper sheet different from that for an image printing region.

(Third Embodiment)

The third embodiment corresponding to the above-described first embodiment will be explained.

In the third embodiment, an overlapping region is set in printing by a printer having heads 11 to 14 to facilitate attachment of the heads.

Figure 9:
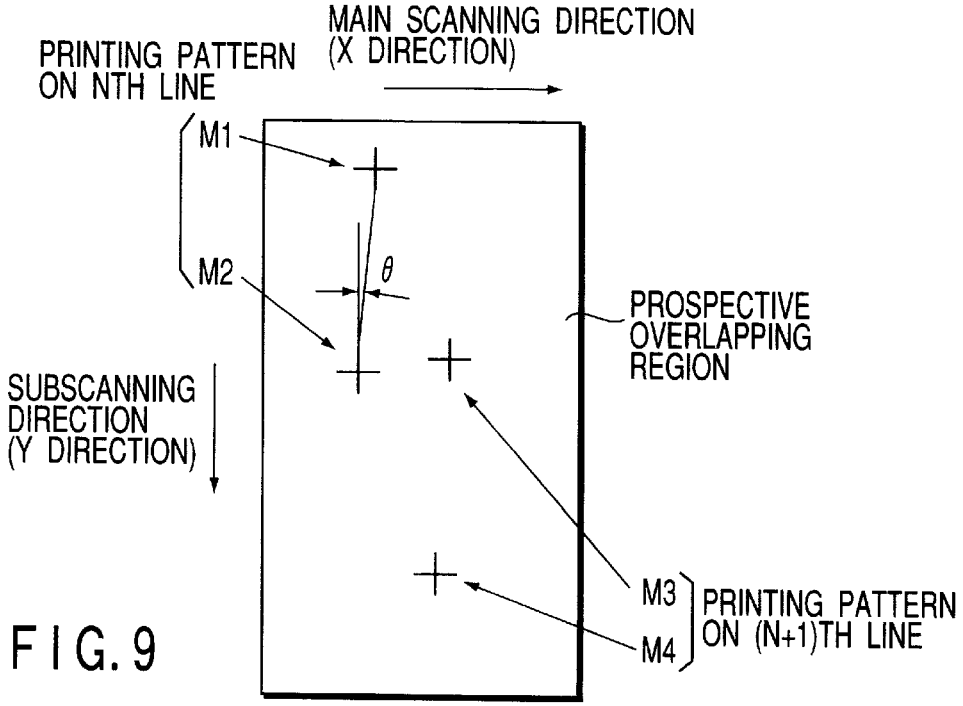
FIG. 9 is a view showing a geometric correction chart used in the third embodiment of the present invention.

FIG. 9 shows a geometric correction chart used in the third embodiment.

In this geometric correction chart, a marker "+" is printed in a prospective overlapping region.

M1 and M2, and M3 and M4 respectively represent Nth and (N+1)th patterns in the geometric correction chart.

Assume that the main scanning and subscanning directions are the x and y directions. M1, M2, M3, and M4, which shift from each other in FIG. 9, are practically laid out at the same x-coordinate. M2 and M3, which shift from each other in FIG. 9, are practically laid out at the same y-coordinate.

Figure 10:
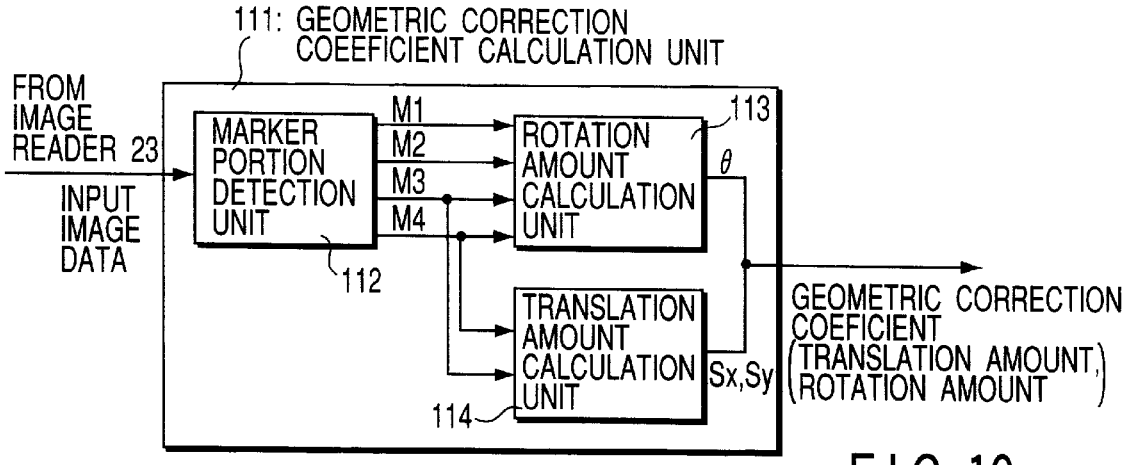
FIG. 10 is a block diagram showing the detailed arrangement of a geometric correction coefficient calculation unit 111 corresponding to the geometric correction coefficient calculation unit 24 in FIG. 4A according to the third embodiment of the present invention.

FIG. 10 shows the detailed arrangement of a geometric correction coefficient calculation unit 111 corresponding to a geometric correction coefficient calculation unit 24 in FIG. 4A.

As shown in FIG. 10, input image data from an image reader 23 in FIG. 4A is input to a marker portion detection unit 112 to detect the marker portions M1, M2, M3, and M4 in the input image data.

A rotation amount calculation unit 113 calculates a rotation angle θ as shown in FIG. 9 from the difference in x-coordinate between the markers M1 and M2 (or M3 and M4) detected by the marker portion detection unit 112.

A translation amount calculation unit 114 calculates translation amounts Sx and Sy from the x- and y-coordinates of the markers M3 and M4 detected by the marker portion detection unit 112.

Geometric correction coefficients including the rotation angle θ and translation amounts Sx and Sy are sent to a geometric correction unit 25 in FIG. 4A to perform affine transformation for printing image data and multiply a multiplication coefficient by a smoothing unit 26 in FIG. 4A, as shown in FIG. 5.

In the third embodiment, as described above, the overlapping region is set in printing by the printer having the heads 11 to 14 to facilitate attachment of the heads and greatly reduce the multihead fabrication time.

Figure 11:
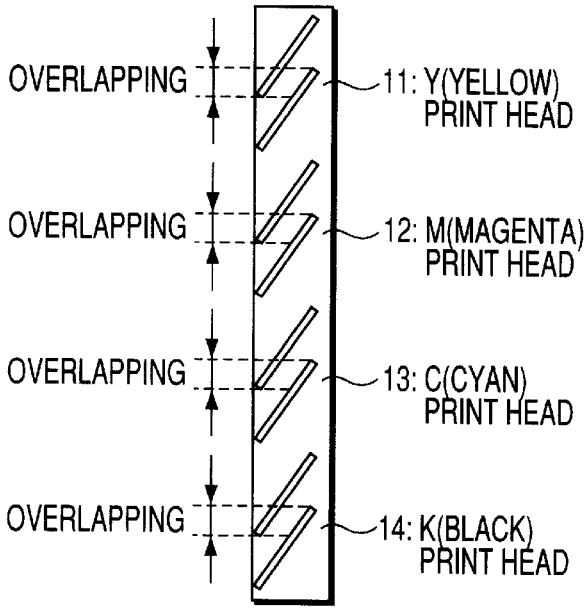
FIG. 11 is a view showing as a modification of the third embodiment of the present invention the case in which each of a Y (Yellow) print head 11, M (Magenta) print head 12, C (Cyan) print head 13, and K (black) print head 14 is made up of two heads.

In the third embodiment, even when each of a Y print head 11, M print head 12, C print head, and K print head 14 is made up of two heads arranged two of unit heads of each color, as shown in FIG. 11, an overlapping region is set between respective unit heads to facilitate attachment of the heads and greatly reduce the fabrication time.

(Fourth Embodiment)

The fourth embodiment corresponding to the second embodiment will be described with reference to FIGS. 12A and 12B to FIG. 16.

Figure 12A:
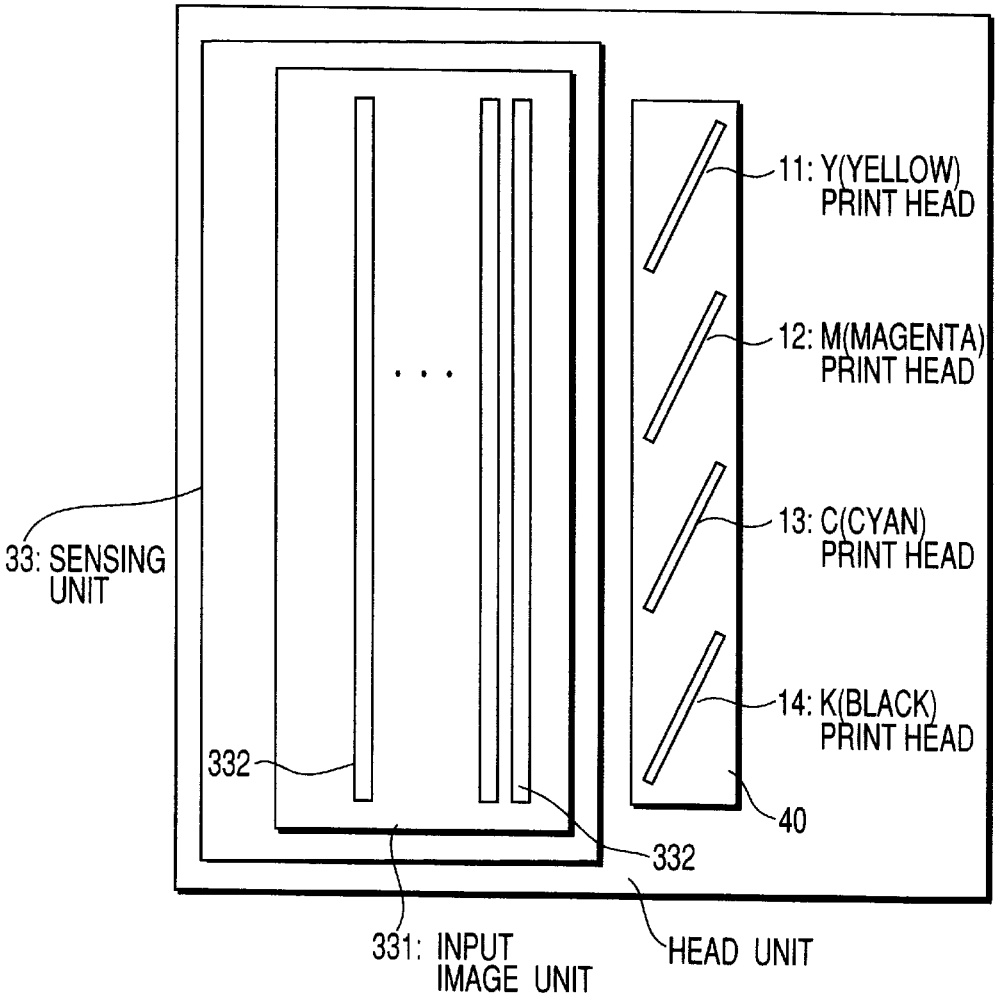
FIGS. 12A and 12B are views, respectively, showing the detailed arrangement of a printer 40 and sensing unit 33 shown in FIG. 6 according to the fourth embodiment of the present invention.

FIG. 12A shows the detailed arrangement of a printer 40 and sensing unit 33 shown in FIG. 6.

According to the characteristic feature of the fourth embodiment, the printer (head unit) 40 having heads 11 to 14 and the sensing unit 33 having an image input unit 331 are integrated to realize downsizing.

Figure 12B:
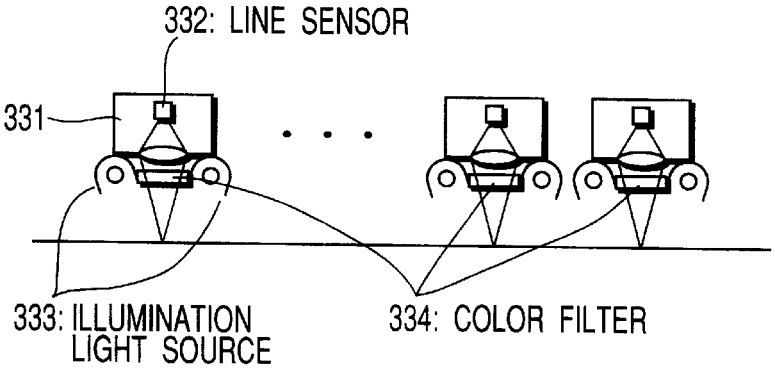

As shown in FIG. 12B, the image input unit 331 in the sensing unit 33 comprises pluralities of line sensors 332 and illumination light sources 333.

As shown in FIG. 12B, the line sensors 332 have color filters 334 having different spectral transmittances, respectively.

In general, a color filter represented by an RGB color filter is used to input a color image. However, the RGB color filter is difficult to accurately measure colors.

Figure 13:
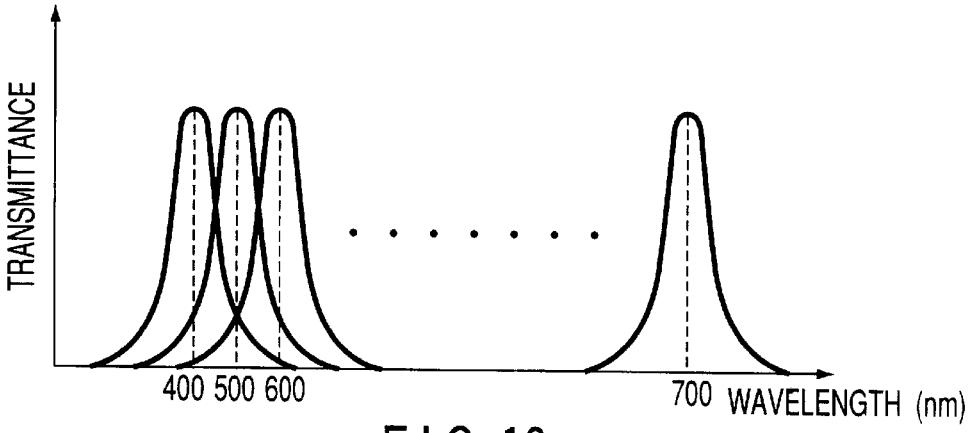
FIG. 13 is a graph showing the characteristics of an interference filter (half-width of 20 nm) of 16 bands used as a color filter 334 in the fourth embodiment of the present invention.

For this reason, the fourth embodiment uses the 16 line sensors 332, and the color filter 334 is made from an interference filter (half-width of 20 nm) of 16 bands having characteristics as shown in FIG. 13.

Figure 14:
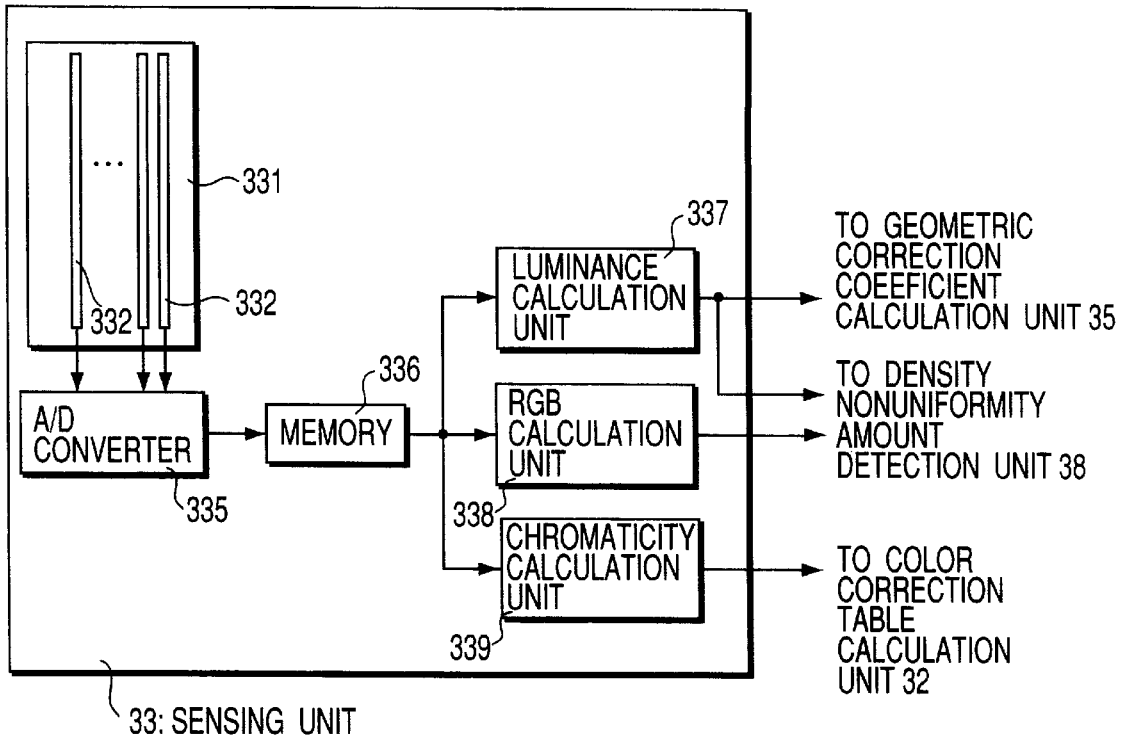
FIG. 14 is a block diagram showing the detailed circuit arrangement of the sensing unit 33 used in the fourth embodiment of the present invention.

In the sensing unit 33, as shown in FIG. 14, a signal from each line sensor 332 is A/D-converted by an analog/digital (A/D) converter 335 and stored in a memory 336. Luminance calculation, RGB calculation, and chromaticity calculation are respectively executed by a luminance calculation unit 337, RGB calculation unit 338, and chromaticity calculation unit 339 using a positionally corresponding signal.

The luminance calculation result, RGB calculation result, and chromaticity calculation result by the luminance calculation unit 337, RGB calculation unit 338, and chromaticity calculation unit 339 are respectively input to a geometric correction coefficient calculation unit 35, density nonuniformity amount detection unit 38, and color correction table calculation unit 32 in FIG. 6.

In chromaticity calculation by the chromaticity calculation unit 339, for example, the Lab values are calculated to create a color correction table.

In this case, since the color filter of 16 bands is used as the color filter 334 attached to the line sensor 332, as described above, the chromaticity value can be calculated at a high precision.

The density nonuniformity amount detection unit 38 preferably calculates density nonuniformity correction data so as to attain a high image contrast between the respective Y, M, C, and K colors.

For this purpose, the density nonuniformities of the Y (Yellow), M (Magenta), C (Cyan), and K (black) heads are respectively detected using images of complementary colors, i.e., B (Blue), G (Green), R (Red), and a luminance signal.

A plurality of color filters allow high-precision on-line correction.

Figure 15:
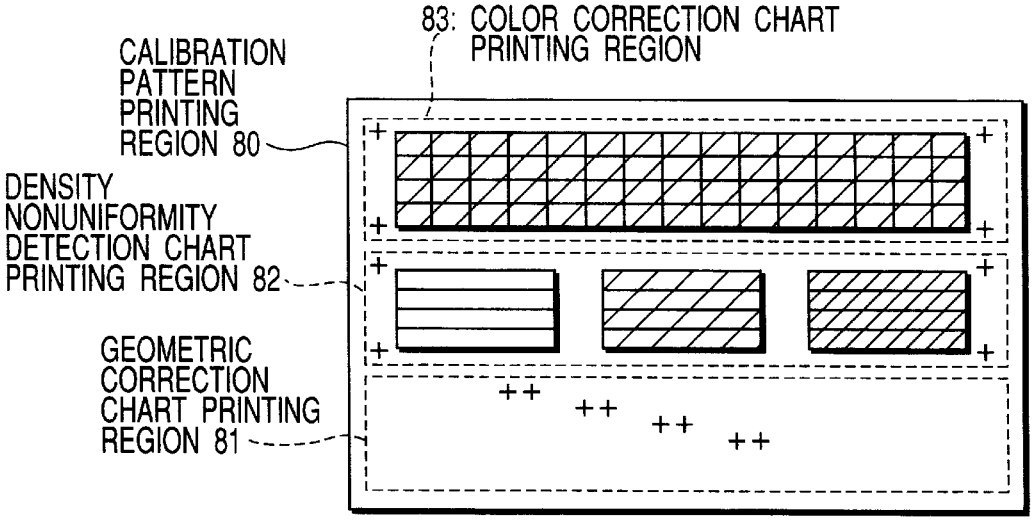
FIG. 15 is a view showing as a test chart used in the fourth embodiment of the present invention an example of a chart in which a geometric correction chart printing region 81, density nonuniformity detection chart printing region 82, and color correction chart printing region 83 are set in a calibration pattern printing region 80.

The correction chart uses a calibration pattern printing region 80 like the one shown in FIG. 15 having a geometric correction chart printing region 81, density nonuniformity detection chart printing region 82, and color correction chart printing region 83.

Figure 16:
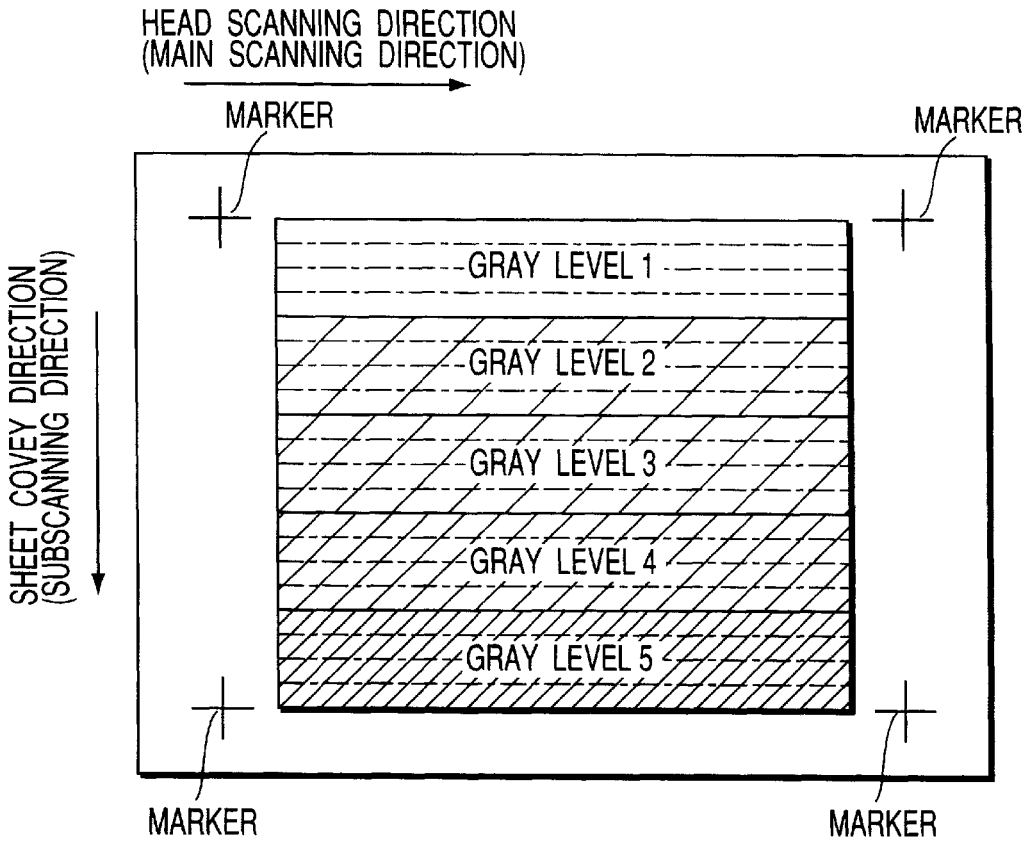
FIG. 16 is a view showing as a density nonuniformity detection chart used in the fourth embodiment of the present invention an example of a uniform pattern having a plurality of densities that is made up of gray levels 1 to 5.
Figure 17A:
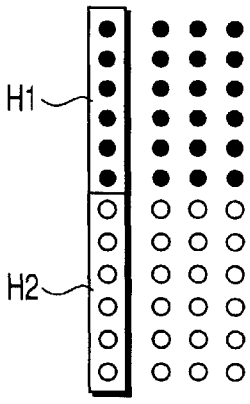
FIG. 17A PRIOR ART
FIGS. 17A, 17B, and 17C are views, respectively, showing an ideal image printing state and undesirable image printing states by a conventional multihead printing apparatus.
Figure 17B:
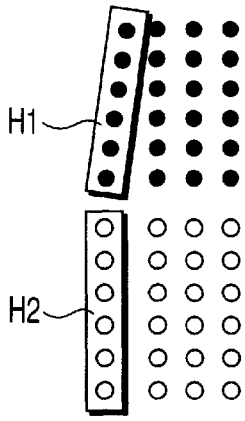
FIG. 17B PRIOR ART
Figure 17C:
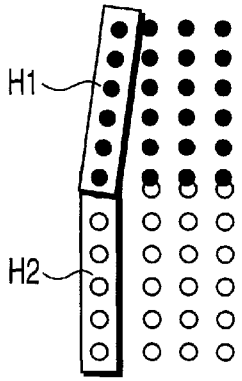
FIG. 17C PRIOR ART

In this case, the geometric correction chart is formed from a pattern "+" like the one used in FIG. 9. The density nonuniformity detection chart is formed from a uniform pattern having gray levels 1 to 5 and a plurality of densities, as shown in FIG. 16.

As the color correction chart, each of the Y, M, C, and K densities is divided into R levels, and R*R*R*R patterns of all combinations are printed in a matrix.

In the fourth embodiment, various correction operations are performed on-line to correct the printing state which changes depending on changes over time and environmental changes. This can always maintain a good printing state.

As has been described above, the present invention can provide an image correction system capable of reducing the number of adjustment steps by electrical signal correction even when the head has an attaching error.

Further, the present invention can provide an image correction system which can greatly reduce the number of adjustment steps by only electrical signal correction even when the head has an attaching error, and which corrects on-line the printing state which changes depending on changes over time and environmental changes.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image correction apparatus for a printing apparatus which prints an image by scanning a multi-unit print head relative to a printing medium in two dimensions, wherein said multi-unit print head comprises a plurality of unit print heads each having a plurality of printing elements that are arranged in a first direction and that are set to form dots, said unit print heads including adjacent unit print heads which partially overlap in the first direction, and constituting a plurality of arrays extending in the first direction, and wherein said image correcting apparatus executes printing in a second direction crossing the first direction, said image correction apparatus comprising:

a geometric correction unit that performs geometric correction processing for input image signals corresponding to the plurality of unit print heads based on shift amounts by which the print heads are shifted from original positions; and a smoothing unit that changes a signal value at a portion corresponding to an overlapping region between respective ones of the unit print heads for the input image signals based on the shift amounts.

2. An apparatus according to claim 1, wherein the apparatus is adapted for use with a printing apparatus comprising a plurality of said multi-unit print heads, and said multi-unit print heads print images of respective different colors.

3. An apparatus according to claim 1, further comprising:

a test image storage unit that stores a predetermined test image;

an image reader unit that reads a printed image obtained by causing the unit print heads to print the predetermined test image from said test image storage unit;

a parameter calculation unit that calculates parameters used by said geometric correction unit based on the shift amounts obtained from image data read by said image reader unit; and a storage unit that stores the parameters calculated by said parameter calculation unit, and wherein said geometric correction unit and said smoothing unit perform correction processing using the parameters stored in said storage unit.

4. An apparatus according to claim 2, further comprising:

a test image storage unit that stores a predetermined test image;

an image reader unit that reads a printed image obtained by causing the unit print heads to print the predetermined test image from said test image storage unit;

a parameter calculation unit that calculates parameters used by said geometric correction unit based on the shift amounts obtained from image data read by said image reader unit; and a storage unit that stores the parameters calculated by said parameter calculation unit, and wherein said geometric correction unit and said smoothing unit perform correction processing using the parameters stored in said storage unit.

5. An image correction apparatus for a printing apparatus which prints an image by scanning a print head having a plurality of printing elements that are arranged in a first direction and that form dots relative to a printing medium such that scanning is executed in the first direction and in a second direction crossing the first direction, said image correction apparatus comprising:

means for scanning the print head such that a region printed by one relative scanning executed in the second direction and a region printed by a next relative scanning executed in the second direction partially overlap with each other in the first direction;

a geometric correction unit that performs a predetermined geometric correction processing for input image signals corresponding to the print head based on shift amounts by which the print head is shifted from an original position; and a smoothing unit that changes a signal value at a portion corresponding to the partially overlapping region for the input image signals based on the shift amounts.

6. An apparatus according to claim 5, wherein the apparatus is adapted for use with a printing apparatus comprising a plurality of unit print heads, and said unit print heads print images of respective different colors.

7. An apparatus according to claim 5, further comprising:

a test image storage unit that stores a predetermined test image;

an image reader unit that reads a printed image obtained by causing the print head to print the predetermined test image from said test image storage unit;

a parameter calculation unit that calculates parameters used by said geometric correction unit based on the shift amounts obtained from image data read by said image reader unit; and a storage unit that stores the parameters calculated by said parameter calculation unit, and wherein said geometric correction unit and said smoothing unit perform correction processing using the parameters stored in said storage unit.

8. An apparatus according to claim 6, further comprising:

a test image storage unit that stores a predetermined test image;

an image reader unit that reads a printed image obtained by causing the unit print heads to print the predetermined test image from said test image storage unit;

a parameter calculation unit that calculates parameters used by said geometric correction unit based on the shift amounts obtained from image data read by said image reader unit; and a storage unit that stores the parameters calculated by said parameter calculation unit, and wherein said geometric correction unit and said smoothing unit perform correction processing using the parameters stored in said storage unit.

9. An image correction apparatus for a printing apparatus which prints an image by scanning a print head having a plurality of printing elements that are arranged in a first direction and that form dots relative to a printing medium such that scanning is executed in the first direction and in a second direction crossing the first direction, said image correction apparatus comprising:

printing means for printing a predetermined correction chart by scanning the print head such that a region printed by one relative scanning executed in the second direction and a region printed by a next relative scanning executed in the second direction partially overlap with each other in the first direction;

reader means for reading a printed image of the predetermined correction chart printed by said printing means;

correction coefficient calculation means for calculating a predetermined correction coefficient based on the printed image of the predetermined correction chart read by said reader means;

an image correction unit that performs predetermined image correction in advance for printing image signals input to the print head, based on the predetermined correction coefficient calculated by said correction coefficient calculation means; and a smoothing unit that performs, with respect to the printing of the image signals input to the print head, signal processing for smoothing in advance a density value at a portion corresponding to the partially overlapping region with respect to a density value at a portion other than the portion corresponding to the partially overlapping region, said density value being smoothed based on said predetermined correction coefficient.

10. An image correction apparatus according to claim 9, wherein:

said image correction unit performs predetermined image correction on-line with respect to the printing of the image signals input to the print head, based on the predetermined correction coefficient calculated by said correction coefficient calculation means.

11. An image correction method for a printing apparatus which prints an image by scanning a print head having a plurality of printing elements that are arranged in a first direction and that form dots relative to a printing medium such that scanning is executed in the first direction and in a second direction crossing the first direction, said image correction method comprising the steps of:

printing a predetermined correction chart by scanning the print head such that a region printed by one relative scanning executed in the second direction and a region printed by a next relative scanning executed in the second direction partially overlap with each other in the first direction;

reading a printed image of the predetermined correction chart;

calculating a predetermined correction coefficient based on the printed image of the predetermined correction chart;

performing predetermined image correction in advance for printing image signals input to the print head, based on the predetermined correction coefficient; and performing, with respect to the printing of the image signals input to the print head, signal processing for smoothing in advance a density value at a portion corresponding to the partially overlapping region with respect to a density value at a portion other than the portion corresponding to the partially overlapping region, said density value being smoothed based on said predetermined correction coefficient.

12. An image correction method according to claim 11, wherein:

said predetermined image correction is performed on-line with respect to the printing of the image signals input to the print head, based on the predetermined correction coefficient.

13. An image correction apparatus for a printing apparatus which prints an image by scanning a multi-unit print head relative to a printing medium in two dimensions, wherein said multi-unit print head comprises a plurality of unit print heads each having a plurality of printing elements that are arranged in a first direction and that are set to form dots, said unit print heads including adjacent unit print heads which partially overlapping in the first direction, and constituting a plurality of arrays extending in the first direction, and wherein said image correcting apparatus executes printing in a second direction crossing the first direction, said image correction apparatus comprising:

an image correction unit that performs predetermined image correction in advance for printing image signals input to the print heads, based on shift amounts by which the print heads are shifted from desired functions; and a smoothing unit that performs, with respect to the printing of the image signals input to the print heads, signal processing for smoothing in advance a density value at a portion corresponding to a partially overlapping region with respect to a density value at a portion other than the portion corresponding to the partially overlapping region, said signal processing being executed based on the shift amounts.

14. An image correction apparatus for a printing apparatus which prints an image by scanning a print head having a plurality of printing elements that are arranged in a first direction and that form dots relative to a printing medium such that scanning is executed in the first direction and in a second direction crossing the first direction, said image correction apparatus comprising:

means for scanning the print head such that a region printed by one relative scanning executed in the second direction and a region printed by a next relative scanning executed in the second direction partially overlap with each other in the first direction;

an image correction unit that performs predetermined image correction in advance for printing image signals input to the print head, based on shift amounts by which the print head is shifted from desired functions; and a smoothing unit that performs, with respect to the printing of the image signals input to the print head, signal processing for smoothing in advance a density value at a portion corresponding to the partially overlapping region with respect to a density value at a portion other than the portion corresponding to the partially overlapping region, said signal processing being executed based on the shift amounts.

* * * * *